US007398625B2

(12) United States Patent
Pervan

(10) Patent No.: US 7,398,625 B2
(45) **Date of Patent: *Jul. 15, 2008**

(54) LOCKING SYSTEM FOR FLOORBOARDS

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 11/341,501

(22) Filed: Jan. 30, 2006

(65) Prior Publication Data

US 2006/0117696 A1 Jun. 8, 2006

Related U.S. Application Data

(63) Continuation of application No. 10/958,233, filed on Oct. 6, 2004, now Pat. No. 7,003,925, which is a continuation of application No. 10/359,615, filed on Feb. 7, 2003, now Pat. No. 6,918,220, which is a continuation of application No. 09/954,180, filed on Sep. 18, 2001, now Pat. No. 6,715,253, which is a continuation of application No. PCT/SE01/00779, filed on Apr. 9, 2000.

(30) Foreign Application Priority Data

Apr. 10, 2000 (SE) ..... 0001325

(51) Int. Cl.
*E04C 3/00* (2006.01)

(52) U.S. Cl. ..... 52/578; 52/403.1; 52/480; 52/506.1; 52/586.2; 52/592.2; 52/551; 52/590.2

(58) Field of Classification Search ..... 52/578, 52/589.1, 586.2, 592.2, 551, 590.2, 581, 52/579, 584.1

See application file for complete search history.

(56) References Cited

U.S. PATENT DOCUMENTS 213,740 A 4/1879 Conner
714,987 A 12/1902 Wolfe
753,791 A 3/1904 Fulghum (Continued)

FOREIGN PATENT DOCUMENTS

AT 218725 B 12/1961

(Continued)

OTHER PUBLICATIONS

Webster's Dictionary, Random House: New York (1987), p. 862.

(Continued)

*Primary Examiner*—Richard E. Chilcot, Jr.
*Assistant Examiner*—Chi Q Nguyen
(74) *Attorney, Agent, or Firm*—Buchanan Ingersoll & Rooney PC

(57) ABSTRACT

The invention relates to a locking system for mechanical joining of floorboards (1, 1'), a floorboard having such a locking system and a flooring made of such floorboards. The locking system has mechanical cooperating means (36, 38; 6, 8, 14) for vertical and horizontal joining of adjoining floorboards. The means for horizontal joining about a vertical plane (F) comprise a locking groove (14) and a locking strip (16) which is located at opposite joint edge portions (4*a*, 4*b*) of the floorboard (4). The locking strip (6) projects from the joint plane (F) and has an upwards projecting locking element (8) at its free end. The locking groove (14) is formed in the opposite joint edge portion (4*a*) of the floorboard at a distance from the joint plane (F). The locking groove (14) and the locking element (8) have operative locking surfaces (10, 11). The locking surfaces are essentially plane and spaced from the upper side of the projecting strip and inside the locking groove and make a locking angle (A) of at least 50° to the upper side of the board. Moreover the locking groove has a guiding part (12) for cooperation with a corresponding guiding part (6) on the locking element (8).

12 Claims, 7 Drawing Sheets

U.S. PATENT DOCUMENTS

| | | | | |
|---|---|---|---|---|
| 1,124,228 | A | | 1/1915 | Houston |
| 1,194,636 | A | | 8/1916 | Joy |
| 1,371,856 | A | | 3/1921 | Cade |
| 1,407,679 | A | | 2/1922 | Ruthrauff |
| 1,454,250 | A | | 5/1923 | Parsons |
| 1,468,288 | A | | 9/1923 | Een |
| 1,477,813 | A | | 12/1923 | Daniels et al. |
| 1,510,924 | A | | 10/1924 | Daniels et al. |
| 1,540,128 | A | | 6/1925 | Houston |
| 1,575,821 | A | | 3/1926 | Daniels |
| 1,602,256 | A | | 10/1926 | Sellin |
| 1,602,267 | A | | 10/1926 | Karwisch |
| 1,615,096 | A | | 1/1927 | Meyers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,778,069 | A | | 10/1930 | Fetz |
| 1,787,027 | A | | 12/1930 | Wasleff |
| 1,790,178 | A | | 1/1931 | Sutherland, Jr. |
| 1,809,393 | A | | 6/1931 | Rockwell |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 5/1933 | Potvin |
| 1,929,871 | A | | 10/1933 | Jones |
| 1,940,377 | A | | 12/1933 | Storm |
| 1,953,306 | A | | 4/1934 | Moratz |
| 1,986,739 | A | | 1/1935 | Mitte |
| 1,988,201 | A | | 1/1935 | Hall |
| 2,026,511 | A | | 12/1935 | Storm |
| 2,044,216 | A | | 6/1936 | Klages |
| 2,266,464 | A | | 12/1941 | Kraft |
| 2,276,071 | A | | 3/1942 | Scull |
| 2,324,628 | A | | 7/1943 | Kähr |
| 2,398,632 | A | | 4/1946 | Frost et al. |
| 2,430,200 | A | | 11/1947 | Wilson |
| 2,495,862 | A | | 1/1950 | Osborn |
| 2,740,167 | A | | 4/1956 | Rowley |
| 2,780,253 | A | | 2/1957 | Joa |
| 2,851,740 | A | | 9/1958 | Baker |
| 2,865,058 | A | | 12/1958 | Andersson et al. |
| 2,894,292 | A | | 7/1959 | Gramelspacher |
| 2,947,040 | A | | 8/1960 | Schultz |
| 3,045,294 | A | | 7/1962 | Livezey, Jr. |
| 3,100,556 | A | | 8/1963 | De Ridder |
| 3,120,083 | A | | 2/1964 | Dahlberg et al. |
| 3,125,138 | A | | 3/1964 | Bolenbach |
| 3,182,769 | A | | 5/1965 | De Ridder |
| 3,200,553 | A | | 8/1965 | Frashour et al. |
| 3,203,149 | A | | 8/1965 | Soddy |
| 3,247,638 | A | | 4/1966 | Gay |
| 3,267,630 | A | | 8/1966 | Omholt |
| 3,282,010 | A | | 11/1966 | King, Jr. |
| 3,301,147 | A | | 1/1967 | Clayton et al. |
| 3,310,919 | A | | 3/1967 | Bue et al. |
| 3,347,048 | A | | 10/1967 | Brown et al. |
| 3,387,422 | A | | 6/1968 | Wanzer |
| 3,460,304 | A | | 8/1969 | Braeuninger et al. |
| 3,481,810 | A | | 12/1969 | Waite |
| 3,508,523 | A | | 4/1970 | De Meerleer |
| 3,526,420 | A | | 9/1970 | Brancalcone |
| 3,538,665 | A | | 11/1970 | Gohner |
| 3,548,559 | A | | 12/1970 | Levine |
| 3,553,919 | A | | 1/1971 | Omholt |
| 3,555,762 | A | | 1/1971 | Costanzo, Jr. |
| 3,579,941 | A | | 5/1971 | Tibbals |
| 3,694,983 | A | | 10/1972 | Couquet |
| 3,714,747 | A | | 2/1973 | Curran |
| 3,731,445 | A | | 5/1973 | Hoffmann et al. |
| 3,759,007 | A | | 9/1973 | Thiele |
| 3,768,846 | A | | 10/1973 | Hensley et al. |
| 3,786,608 | A | | 1/1974 | Boettcher |
| 3,842,562 | A | | 10/1974 | Daigle |
| 3,857,749 | A | | 12/1974 | Yoshida |
| 3,859,000 | A | | 1/1975 | Webster |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,037,377 | A | | 7/1977 | Howell et al. |
| 4,084,996 | A | | 4/1978 | Wheeler |
| 4,090,338 | A | | 5/1978 | Bourgade |
| 4,099,358 | A | | 7/1978 | Compaan |
| 4,100,710 | A | | 7/1978 | Kowallik |
| 4,169,688 | A | | 10/1979 | Toshio |
| 4,227,430 | A | | 10/1980 | Jansson et al. |
| 4,242,390 | A | | 12/1980 | Nemeth |
| 4,299,070 | A | | 11/1981 | Oltmanns et al. |
| 4,304,083 | A | | 12/1981 | Anderson |
| 4,426,820 | A | | 1/1984 | Terbrack et al. |
| 4,471,012 | A | | 9/1984 | Maxwell |
| 4,489,115 | A | | 12/1984 | Layman et al. |
| 4,501,102 | A | | 2/1985 | Knowles |
| 4,561,233 | A | | 12/1985 | Harter et al. |
| 4,567,706 | A | | 2/1986 | Wendt |
| 4,612,074 | A | | 9/1986 | Smith et al. |
| 4,612,745 | A | | 9/1986 | Hovde |
| 4,641,469 | A | | 2/1987 | Wood |
| 4,643,237 | A | | 2/1987 | Rosa |
| 4,646,494 | A | | 3/1987 | Saarinen et al. |
| 4,648,165 | A | | 3/1987 | Whitehorne |
| 4,653,242 | A | | 3/1987 | Ezard |
| 4,703,597 | A | | 11/1987 | Eggemar |
| 4,715,162 | A | | 12/1987 | Brightwell |
| 4,716,700 | A | | 1/1988 | Hagemeyer |
| 4,738,071 | A | | 4/1988 | Ezard |
| 4,769,963 | A | | 9/1988 | Meyerson |
| 4,819,932 | A | | 4/1989 | Trotter, Jr. |
| 4,822,440 | A | * | 4/1989 | Hsu et al. ..... 156/307.5 |
| 4,831,806 | A | | 5/1989 | Niese et al. |
| 4,845,907 | A | | 7/1989 | Meek |
| 4,905,442 | A | | 3/1990 | Daniels |
| 5,029,425 | A | | 7/1991 | Bogataj |
| 5,113,632 | A | | 5/1992 | Hanson |
| 5,117,603 | A | | 6/1992 | Weintraub |
| 5,148,850 | A | | 9/1992 | Urbanick |
| 5,165,816 | A | | 11/1992 | Parasin |
| 5,179,812 | A | | 1/1993 | Hill |
| 5,216,861 | A | | 6/1993 | Meyerson |
| 5,253,464 | A | | 10/1993 | Nilsen |
| 5,271,564 | A | | 12/1993 | Smith |
| 5,286,545 | A | * | 2/1994 | Simmons, Jr. ..... 428/192 |
| 5,295,341 | A | | 3/1994 | Kajiwara |
| 5,349,796 | A | | 9/1994 | Meyerson |
| 5,390,457 | A | | 2/1995 | Sjölander |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,560,569 | A | | 10/1996 | Schmidt |
| 5,567,497 | A | | 10/1996 | Zegler et al. |
| 5,570,554 | A | | 11/1996 | Searer |
| 5,597,024 | A | | 1/1997 | Bolyard et al. |
| 5,613,894 | A | | 3/1997 | Delle Vedove |
| 5,618,602 | A | | 4/1997 | Nelson |
| 5,630,304 | A | | 5/1997 | Austin |
| 5,653,099 | A | | 8/1997 | MacKenzie |

| | | | | |
|---|---|---|---|---|
| 5,671,575 | A | | 9/1997 | Wu |
| 5,695,875 | A | | 12/1997 | Larsson et al. |
| 5,706,621 | A | | 1/1998 | Pervan |
| 5,755,068 | A | | 5/1998 | Ormiston |
| 5,768,850 | A | | 6/1998 | Chen |
| 5,797,237 | A | | 8/1998 | Finkell, Jr. |
| 5,823,240 | A | | 10/1998 | Bolyard et al. |
| 5,827,592 | A | | 10/1998 | Van Gulik et al. |
| 5,860,267 | A | | 1/1999 | Pervan |
| 5,899,038 | A | | 5/1999 | Stroppiana |
| 5,900,099 | A | | 5/1999 | Sweet et al. |
| 5,925,211 | A | * | 7/1999 | Rakauskas ..... 156/306.9 |
| 5,935,668 | A | | 8/1999 | Smith |
| 5,943,239 | A | | 8/1999 | Shamblin et al. |
| 5,968,625 | A | | 10/1999 | Hudson |
| 5,987,839 | A | | 11/1999 | Hamar et al. |
| 6,006,486 | A | | 12/1999 | Moriau et al. |
| 6,023,907 | A | | 2/2000 | Pervan |
| 6,029,416 | A | | 2/2000 | Andersson |
| 6,094,882 | A | | 8/2000 | Pervan |
| 6,101,778 | A | | 8/2000 | Martensson |
| 6,119,423 | A | | 9/2000 | Costantino |
| 6,134,854 | A | | 10/2000 | Stanchfield |
| 6,148,884 | A | | 11/2000 | Bolyard et al. |
| 6,173,548 | B1 | | 1/2001 | Hamar et al. |
| 6,182,410 | B1 | | 2/2001 | Pervan |
| 6,203,653 | B1 | | 3/2001 | Seidner |
| 6,205,639 | B1 | | 3/2001 | Pervan |
| 6,209,278 | B1 | | 4/2001 | Tychsen |
| 6,216,403 | B1 | | 4/2001 | Belbeoc'h |
| 6,216,409 | B1 | | 4/2001 | Roy et al. |
| 6,247,285 | B1 | | 6/2001 | Mobeus |
| 6,314,701 | B1 | | 11/2001 | Meyerson |
| 6,324,803 | B1 | | 12/2001 | Pervan |
| 6,332,733 | B1 | | 12/2001 | Hamberger et al. |
| 6,339,908 | B1 | | 1/2002 | Chuang |
| 6,345,481 | B1 | | 2/2002 | Nelson |
| 6,363,677 | B1 | | 4/2002 | Chen et al. |
| 6,385,936 | B1 | | 5/2002 | Schneider |
| 6,397,547 | B1 | | 6/2002 | Martensson |
| 6,421,970 | B1 | | 7/2002 | Martensson et al. |
| 6,438,919 | B1 | | 8/2002 | Knauseder |
| 6,446,405 | B1 | | 9/2002 | Pervan |
| 6,490,836 | B1 | | 12/2002 | Moriau et al. |
| 6,497,079 | B1 | | 12/2002 | Pletzer et al. |
| 6,505,452 | B1 | | 1/2003 | Hannig et al. |
| 6,510,665 | B2 | | 1/2003 | Pervan |
| 6,516,579 | B1 | | 2/2003 | Pervan |
| 6,526,719 | B2 | | 3/2003 | Pletzer et al. |
| 6,532,709 | B2 | | 3/2003 | Pervan |
| 6,536,178 | B1 | | 3/2003 | Palsson et al. |
| 6,584,747 | B2 | | 7/2003 | Kettler et al. |
| 6,601,359 | B2 | | 8/2003 | Olofsson |
| 6,606,834 | B2 | | 8/2003 | Martensson et al. |
| 6,647,689 | B2 | | 11/2003 | Pletzer et al. |
| 6,647,690 | B1 | | 11/2003 | Martensson |
| 6,670,019 | B2 | | 12/2003 | Andersson |
| 6,672,030 | B2 | | 1/2004 | Schulte |
| 6,684,592 | B2 | | 2/2004 | Martin |
| 6,715,253 | B2 | | 4/2004 | Pervan |
| 6,722,809 | B2 | | 4/2004 | Hamberger et al. |
| 6,763,643 | B1 | | 7/2004 | Martensson |
| 6,769,218 | B2 | | 8/2004 | Pervan |
| 6,769,219 | B2 | | 8/2004 | Schwitte et al. |
| 6,786,019 | B2 | | 9/2004 | Thiers |
| 6,854,235 | B2 | | 2/2005 | Martensson |
| 6,862,857 | B2 | | 3/2005 | Tychsen |
| 6,874,292 | B2 | | 4/2005 | Moriau et al. |
| 6,933,043 | B1 | | 8/2005 | Son et al. |
| 7,003,924 | B2 | | 2/2006 | Kettler et al. |
| 7,003,925 | B2 | * | 2/2006 | Pervan ..... 52/578 |
| 7,022,189 | B2 | | 4/2006 | Delle Vedove et al. |
| 7,040,068 | B2 | | 5/2006 | Moriau et al. |
| 2001/0029720 | A1 | | 10/2001 | Pervan |
| 2002/0014047 | A1 | | 2/2002 | Thiers |
| 2002/0020127 | A1 | | 2/2002 | Thiers et al. |
| 2002/0031646 | A1 | | 3/2002 | Chen et al. |
| 2002/0046528 | A1 | | 4/2002 | Pervan et al. |
| 2002/0069611 | A1 | | 6/2002 | Leopolder |
| 2002/0100231 | A1 | | 8/2002 | Miller et al. |
| 2002/0178673 | A1 | | 12/2002 | Pervan |
| 2002/0178674 | A1 | | 12/2002 | Pervan |
| 2002/0178682 | A1 | | 12/2002 | Pervan |
| 2003/0009972 | A1 | | 1/2003 | Pervan et al. |
| 2003/0024199 | A1 | | 2/2003 | Pervan et al. |
| 2003/0033777 | A1 | | 2/2003 | Thiers et al. |
| 2003/0033784 | A1 | | 2/2003 | Pervan |
| 2003/0041545 | A1 | | 3/2003 | Stanchfield |
| 2003/0084636 | A1 | | 5/2003 | Pervan |
| 2003/0101674 | A1 | | 6/2003 | Pervan et al. |
| 2003/0115812 | A1 | | 6/2003 | Pervan |
| 2003/0115821 | A1 | | 6/2003 | Pervan |
| 2003/0196405 | A1 | | 10/2003 | Pervan |
| 2003/0233809 | A1 | | 12/2003 | Pervan |
| 2004/0016196 | A1 | | 1/2004 | Pervan |
| 2004/0035078 | A1 | | 2/2004 | Pervan |
| 2004/0139678 | A1 | | 7/2004 | Pervan |
| 2004/0177584 | A1 | | 9/2004 | Pervan |
| 2004/0206036 | A1 | | 10/2004 | Pervan |
| 2004/0241374 | A1 | | 12/2004 | Thiers et al. |
| 2004/0255541 | A1 | | 12/2004 | Thiers et al. |
| 2005/0034404 | A1 | | 2/2005 | Pervan |
| 2005/0034405 | A1 | | 2/2005 | Pervan |
| 2005/0055943 | A1 | | 3/2005 | Pervan |
| 2005/0102937 | A1 | | 5/2005 | Pervan |
| 2005/0138881 | A1 | | 6/2005 | Pervan |
| 2005/0160694 | A1 | | 7/2005 | Pervan |
| 2005/0161468 | A1 | | 7/2005 | Wagner |
| 2005/0166502 | A1 | | 8/2005 | Pervan et al. |
| 2005/0166514 | A1 | | 8/2005 | Pervan |
| 2005/0166516 | A1 | | 8/2005 | Pervan |
| 2005/0193677 | A1 | | 9/2005 | Vogel |
| 2005/0208255 | A1 | | 9/2005 | Pervan |
| 2005/0210810 | A1 | | 9/2005 | Pervan |
| 2005/0235593 | A1 | | 10/2005 | Hecht |
| 2006/0048474 | A1 | | 3/2006 | Pervan et al. |
| 2006/0070333 | A1 | | 4/2006 | Pervan |
| 2006/0073320 | A1 | | 4/2006 | Pervan et al. |
| 2006/0075713 | A1 | | 4/2006 | Pervan et al. |
| 2006/0101769 | A1 | | 5/2006 | Pervan et al. |
| 2006/0179773 | A1 | | 8/2006 | Pervan |
| 2006/0196139 | A1 | | 9/2006 | Pervan |
| 2006/0283127 | A1 | | 12/2006 | Pervan |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 991373 | | 6/1976 |
| CA | 2226286 | | 12/1997 |
| CA | 2252791 | | 5/1999 |
| CA | 2289309 | | 7/2000 |
| CA | 2 363 184 | A1 | 7/2001 |
| CH | 200949 | | 1/1939 |
| CH | 211877 | | 1/1941 |
| CH | 690242 | A5 | 6/2000 |
| DE | 1 212 275 | | 3/1966 |
| DE | 7102476 | | 1/1971 |
| DE | 1 534 278 | | 11/1971 |
| DE | 2 159 042 | | 11/1971 |
| DE | 2 205 232 | | 8/1973 |
| DE | 7402354 | | 1/1974 |

| | | | |
|---|---|---|---|
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 35 38 538 | A1 | 10/1985 |
| DE | 86 04 004 | | 6/1986 |
| DE | 8604004 | | 6/1986 |
| DE | 35 12 204 | A1 | 10/1986 |
| DE | 35 44 845 | A1 | 6/1987 |
| DE | 36 31 390 | A1 | 12/1987 |
| DE | 40 02 547 | A1 | 8/1991 |
| DE | 41 30 115 | A1 | 9/1991 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 3/1995 |
| DE | 296 10 462 | U1 | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 299 22 649 | U1 | 4/2000 |
| DE | 200 01 225 | U1 | 8/2000 |
| DE | 200 02 744 | U1 | 9/2000 |
| DE | 199 25 248 | A1 | 12/2000 |
| DE | 200 13 380 | U1 | 12/2000 |
| DE | 200 17 461 | U1 | 3/2001 |
| DE | 200 18 284 | U1 | 3/2001 |
| DE | 100 01 248 | A1 | 7/2001 |
| DE | 100 32 204 | C1 | 7/2001 |
| DE | 100 44 016 | A1 | 3/2002 |
| DE | 202 05 774 | U1 | 8/2002 |
| DE | 203 07 580 | U1 | 7/2003 |
| DE | 203 17 527 | U1 | 1/2004 |
| DE | 20 2004 001 038 | U1 | 5/2004 |
| DE | 20 2005 006 300 | U1 | 8/2005 |
| DE | 10 2004 054 368 | A1 | 5/2006 |
| EP | 0 248 127 | A1 | 12/1987 |
| EP | 0 487 925 | A1 | 6/1992 |
| EP | 0 623 724 | A1 | 11/1994 |
| EP | 0 652 340 | A1 | 5/1995 |
| EP | 0 665 347 | A1 | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 958 441 | | 11/1998 |
| EP | 0 661 135 | B1 | 12/1998 |
| EP | 0 903 451 | A2 | 3/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | A1 | 2/2000 |
| EP | 1 045 083 | | 10/2000 |
| EP | 1 048 423 | A2 | 11/2000 |
| EP | 1 120 515 | A1 | 8/2001 |
| EP | 1 146 182 | A2 | 10/2001 |
| EP | 1 165 906 | A1 | 1/2002 |
| EP | 1 223 265 | A2 | 7/2002 |
| EP | 1 251 219 | A1 | 10/2002 |
| EP | 1 262 609 | A1 | 12/2002 |
| EP | 1 317 983 | A2 | 6/2003 |
| EP | 1 338 344 | A2 | 8/2003 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| FR | 2 810 060 | A1 | 12/2001 |
| FR | 2 846 023 | A1 | 4/2004 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1171337 | | 11/1969 |
| GB | 1237744 | | 6/1971 |
| GB | 1275511 | | 5/1972 |
| GB | 1 394 621 | | 5/1975 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 3-169967 | | 7/1991 |
| JP | 4-106264 | | 4/1992 |
| JP | 4-191001 | | 7/1992 |
| JP | 5-148984 | | 6/1993 |
| JP | 6-56310 | | 5/1994 |
| JP | 6-146553 | | 5/1994 |
| JP | 6-320510 | | 11/1994 |
| JP | 7-076923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 9-38906 | | 2/1997 |
| JP | 9-88315 | | 3/1997 |
| JP | 2000 179137 | | 6/2000 |
| JP | 2000 226932 | | 8/2000 |
| JP | 2001 173213 | | 6/2001 |
| JP | 2001 179710 | | 7/2001 |
| JP | 2001 254503 | | 9/2001 |
| JP | 2001 260107 | | 9/2001 |
| JP | 2001 329681 | | 11/2001 |
| NL | 7901773 | | 8/1976 |
| NO | 157871 | | 7/1984 |
| NO | 305614 | | 5/1995 |
| PL | 26931 | U | 6/1905 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |

| | | | |
|---|---|---|---|
| SU | 1680359 | A1 | 9/1991 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | WO 97/19232 | A1 | 5/1997 |
| WO | WO 97/47834 | | 12/1997 |
| WO | WO 98/22677 | A1 | 5/1998 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/20705 | A1 | 4/2000 |
| WO | WO 00/20706 | A1 | 4/2000 |
| WO | WO 00/66856 | A1 | 11/2000 |
| WO | WO 01/02669 | A1 | 1/2001 |
| WO | WO 01/07729 | A1 | 2/2001 |
| WO | 01/51733 | A1 | 7/2001 |
| WO | WO 01/66876 | A1 | 9/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/96688 | A1 | 12/2001 |
| WO | WO 01/98603 | A2 | 12/2001 |
| WO | WO 01/98604 | A1 | 12/2001 |
| WO | 02/055809 | A1 | 7/2002 |
| WO | 02/055810 | A1 | 7/2002 |
| WO | WO 02/060691 | A1 | 8/2002 |
| WO | WO 03/016654 | A1 | 2/2003 |
| WO | 03/070384 | | 8/2003 |
| WO | 03/078761 | | 9/2003 |
| WO | WO 03/074814 | A1 | 9/2003 |
| WO | 06/113757 | | 10/2003 |
| WO | WO 03/083234 | A1 | 10/2003 |
| WO | 03/099461 | | 12/2003 |
| WO | WO 04/083557 | A1 | 9/2004 |
| WO | 05/077625 | | 8/2005 |
| WO | 05/110677 | | 11/2005 |
| WO | 06/008578 | | 1/2006 |
| WO | 06/111437 | | 10/2006 |

OTHER PUBLICATIONS

Knight's American Mechanical Dictionary, Hurd and Houghton: New York (1876), p. 2051.
Opposition EP 0.698,162 B1—Facts-Grounds-Arguments, dated Apr. 1, 1999, pp. 1-56.
Opposition II EP 0.698,162 B1—Fact-Grounds-Arguments, dated Apr. 30, 1999, (17 pages)—with translation (11 pages).
Opposition I: Unilin Dector N. V./Välinge Aluminum AB, communication dated Jun. 8, 1999 to European Patent Office, pp. 1-2.
Opposition I: Unilin Decor N.V./Välinge Aluminum AB, communication dated Jun. 16, 1999 to European Patent Office, pp. 1-2.
FI Office Action dated Mar. 19, 1998.
NO Office Action dated Dec. 22, 1997.
NO Office Action dated Sep. 21, 1998.
Opposition EP 0.877.130 B1—Facts—Arguments, dated Jun. 28, 2000, pp. 1-13.
RU Application Examiner Letter dated Sep. 26, 1997.
NZ Application Examiner Letter dated Oct. 21, 1999.
European prosecution file history to grant, European Patent No. 94915725.9-2303/0698162, grant date Sep. 17, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000 in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
Välinge, "Fibo-Trespo" Brochure, Distributed at the Domotex Fair In Hannover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published by Institutet for Trateknist Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC und Parkett verlegen", Published by Compact Verlag, München, Germany 1985, pp. 84-87.
Pamphlet from Junckers Industrser A/S entitled"Bøjlesystemet til Junckers boliggulve" Oct. 1994, , Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Pergo, Inc. V. Välinge Aluminium AB, Berry Finance NV, and Alloc, Inc.; U.S. District Court for the District of Columbia; Civil Action No. 1:00CV01618.
Alloc, Inc. v. Unilin Decor NV and BHK of America, Inc.; U.S. District Court for the Eastern District of Wisconsin; Civil Action. 00-C-0999.
Unilin Beheer B.V., Unilin Decor, N.V., and BHK of America, Inc. v. Välinge Aluminium AB; U.S. District Court for the District of Columbia; Civil Action No. 1:00CV01823.

Alloc, Inc., Berry Finance NV, and Välinge Aluminium AB v. Unilin Decor NV, BHK of America, Inc., Pergo, Inc., Meister-Leisten Schulte GmbH Akzenta Paneele+Profile GmbH, Tarkett, Inc., and Roysol; ITC No. 337-TA-443.
Alloc, Inc., Berry Finance NV, and Välinge Aluminum AB v. Tarkett, Inc.; U.S. District Court for the Eastern District of Wisconsin; Civil Action No. 00-CV-1377.
Darko Pervan, U.S. Appl. No. 09/714,514 entitled "Locking System and Flooring Board" filed Nov. 17, 2000.
Darko Pervan, U.S. Appl. No. 11/092,748 entitled "Mechanical Locking System for Panels and Method of Installing Same" filed Mar. 30, 2005.
Darko Pervan, U.S. Appl. No. 10/908,658 entitled "Mechanical Locking System for Floor Panels " filed May 20, 2005.
Darko Pervan, U.S. Appl. No. 11/509, 718 entitled "Floor Panel With a Tongue, Groove and a Strip" filed Aug. 25, 2006.
Jacobsson, Jan, et al., U.S. Appl. No. 11/521,439, entitled "Device and Method for Compressing an Edge of a Building Panel and a Building Panel With Compressed Edges", filed on Sep. 15, 2006.
Pervan, Darko, U.S. Appl. No. 11/627,971, entitled "Locking System for Floorboards", filed on Jan. 28, 2007.

* cited by examiner

PRIOR ART

PRIOR ART

LOCKING SYSTEM FOR FLOORBOARDS

TECHNICAL FIELD

The invention generally relates to the field of mechanical locking of floorboards. The invention relates to an improved locking system for mechanical locking of floorboards, a floorboard provided with such an improved locking system, and a flooring made of such mechanically joined floorboards. The invention generally relates to an improvement of a locking system of the type described and shown in WO 9426999 and WO 9966151.

More specifically, the invention relates to a locking system for mechanical joining of floorboards of the type having a core and preferably a surface layer on the upper side of the core and a balancing layer on the rear side of the core, said locking system comprising: (i) for horizontal joining of a first and a second joint edge portion of a first and a second floorboard respectively at a vertical joint plane, on the one hand a locking groove which is formed in the underside of said second board and extends parallel with and at a distance from said vertical joint plane at said second joint edge and, on the other hand, a strip integrally formed with the core of said first board, which strip at said first joint edge projects from said vertical joint plane and supports a locking element, which projects towards a plane containing the upper side of said first floorboard and which has a locking surface for coaction with said locking groove, and (ii) for vertical joining of the first and second joint edge, on the one hand a tongue which at least partly projects and extends from the joint plane and, on the other hand, a tongue groove adapted to coact with said tongue, the first and second floorboards within their joint edge portions for the vertical joining having coacting upper and coacting lower contact surfaces, of which at least the upper comprise surface portions in said tongue groove and said tongue.

FIELD OF APPLICATION OF THE INVENTION

The present invention is particularly suitable for mechanical joining of thin floating floors of floorboards made up of an upper surface layer, an intermediate fibreboard core and a lower balancing layer, such as laminate flooring and veneer flooring with a fibreboard core. Therefore, the following description of the state of the art, problems associated with known systems, and the objects and features of the invention will, as a non-restricting example, focus on this field of application and, in particular, on rectangular floorboards with dimensions of about 1.2 m*0.2 m and a thickness of about 7-10 mm, intended to be mechanically joined at the long side as well as the short side.

BACKGROUND OF THE INVENTION

Thin laminate flooring and wood veneer flooring are usually composed of a core consisting of a 6-9 mm fibreboard, a 0.20-0.8 mm thick upper surface layer and a 0.1-0.6 mm thick lower balancing layer. The surface layer provides appearance and durability to the floorboards. The core provides stability and the balancing layer keeps the board level when the relative humidity (RH) varies during the year. The RH can vary between 15% and 90%. Conventional floorboards of the type are usually joined by means of glued tongue-and-groove joints (i.e. joints involving a tongue on a floorboard and a tongue groove on an adjoining floorboard) at the long and short sides. When laying the floor, the boards are brought together horizontally, whereby a projecting tongue along the joint edge of a first board is introduced into a tongue groove along the joint edge of the second adjoining board. The same method is used at the long side as well as the short side. The tongue and the tongue groove are designed for such horizontal joining only and with special regard to how glue pockets and gluing surfaces should be designed to enable the tongue to be efficiently glued within the tongue groove. The tongue-and-groove joint presents coacting upper and lower contact surfaces that position the boards vertically in order to ensure a level surface of the finished floor.

In addition to such conventional floors, which are connected by means of glued tongue-and-groove joints, floorboards have recently been developed which are instead mechanically joined and which do not require the use of glue. This type of mechanical joint system is hereinafter referred to as a "strip-lock system", since the most characteristic component of this system is a projecting strip which supports a locking element.

WO 9426999 and WO 9966151 (owner Valinge Aluminium AB) disclose a strip-lock system for joining building panels, particularly floorboards. This locking system allows the boards to be locked mechanically at right angles to as well as parallel with the principal plane of the boards at the long side as well as at the short side. Methods for making such floorboards are disclosed in EP 0958441 and EP 0958442 (owner Valinge Aluminium AB). The basic principles of the design and the installation of the floorboards, as well as the methods for making the same, as described in the four above-mentioned documents, are usable for the present invention as well, and therefore these documents are hereby incorporated by reference.

In order to facilitate the understanding and description of the present invention, as well as the comprehension of the problems underlying the invention, a brief description of the basic design and function of the known floorboards according to the above-mentioned WO 9426999 and WO 9966151 will be given below with reference to FIGS. 1-3 in the accompanying drawings. Where applicable, the following description of the prior art also applies to the embodiments of the present invention described below.

FIGS. 3*a* and 3*b* are thus a top view and a bottom view respectively of a known floorboard 1. The board 1 is rectangular with a top side 2, an underside 3, two opposite long sides with joint edge portions 4*a*, 4*b* and two-opposite short sides with joint edge portions 5*a*, 5*b*.

Without the use of the glue, both the joint edge portions 4*a*, 4*b* of the long sides and the joint edge portions 5*a*, 5*b* of the short sides can be joined mechanically in a direction D2 in FIG. 1*c*, so that they join in a joint plane F (marked in FIG. 2*c*). For this purpose, the board 1 has a flat strip 6, mounted at the factory, which strip extends throughout the length of the long side 4*a* and which is made of flexible, resilient sheet aluminium. The strip 6 projects from the joint plane F at the joint edge portion 4*a*. The strip 6 can be fixed mechanically according to the embodiment shown, or by means of glue, or in some other way. Other strip materials can be used, such as sheets of other metals, as well as aluminium or plastic sections. Alternatively, the strip 6 may be made in one piece with the board 1, for example by suitable working of the core of the board 1. The present invention is usable for floorboards in which the strip is integrally formed with the core, and solves special problems appearing in such floorboards and the making thereof. The core of the floorboard need not be, but is preferably, made of a uniform material. However, the strip 6 is always integrated with the board 1, i.e. it is never mounted on the board 1 in connection with the laying of the floor but it is mounted or formed at the factory. The width of the strip 6 can be about 30 mm and its thickness about 0.5 mm. A similar, but shorter strip 6' is provided along one short side 5*a* of the board 1. The part of the strip 6 projecting from the joint plane F is formed with a locking element 8 extended throughout the length of the strip 6. The locking element 8 has in its lower part an operative locking surface 10 facing the joint plane F and having a height of e.g. 0.5 mm. When the floor is being laid, this locking surface 10 coacts with a locking groove 14 formed in the underside 3 of the joint edge portion 4*b* of the opposite long side of an adjoining board 1'. The short side strip 6' is provided with a corresponding locking element 8', and the joint edge portion 5*b* of the opposite short side has a corresponding locking groove 14'. The edge of the locking grooves 14, 14' closest to the joint plane F forms an operative locking surface 11 for coaction with the operative locking surface 10 of the locking element.

Moreover, for mechanical joining of both long sides and short sides also in the vertical direction (direction D1 in FIG. 1*c*) the board 1 is formed with a laterally open recess 16 along one long side (joint edge portion 4*a*) and one short side (joint edge portion 5*a*). At the bottom, the recess 16 is defined by the respective strips 6, 6'. At the opposite edge portions 4*b* and 5*b* there is an upper recess 18 defining a locking tongue 20 coacting with the recess 16 (see FIG. 2*a*).

FIGS. 1*a*-1*c* show how two long sides 4*a*, 4*b* of two such boards 1, 1' on an underlay U can be joined together by means of downward angling. FIGS. 2*a*-2*c* show how the short sides 5*a*, 5*b* of the boards 1, 1' can be joined together by snap action. The long sides 4*a*, 4*b* can be joined together by means of both methods, while the short sides 5*a*, 5*b*—when the first row has been laid—are normally joined together subsequent to joining together the long sides 4*a*, 4*b* and by means of snap action only.

When a new board 1' and a previously installed board 1 are to be joined together along their long side edge portions 4*a*, 4*b* as shown in FIGS. 1*a*-1*c*, the long side edge portion 4*b* of the new board 1' is pressed against the long side edge portion 4*a* of the previous board 1 as shown in FIG. 1*a*, so that the locking tongue 20 is introduced into the recess 16. The board 1' is then angled downwards towards the subfloor. U according to FIG. 1*b*. In this connection, the locking tongue 20 enters the recess 16 completely, while the locking element 8 of the strip 6 enters the locking groove 14. During this downward angling, the upper part 9 of the locking element 8 can be operative—and provide guiding of the new board 1' towards the previously installed board 1. In the joined position as shown in FIG. 1*c*, the boards 1, 1' are locked in both the direction D1 and the direction D2 along their long side edge portions 4*a*, 4*b*, but the boards 1, 1' can be mutually displaced in the longitudinal direction of the joint along the long sides.

FIGS. 2*a*-2*c* show how the short side edge portions 5*a* and 5*b* of the boards 1, 1' can be mechanically joined in the direction D1 as well as the direction D2 by moving the new board 1' towards the previously installed board 1 essentially horizontally. Specifically, this can be carried out subsequent to joining the long side of the new board 1' to a previously installed board 1 in an adjoining row by means of the method according to FIGS. 1*a*-1*c*. In the first step in FIG. 2*a*, bevelled surfaces adjacent to the recess 16 and the locking tongue 20 respectively cooperate such that the strip 6' is forced to move downwards as a direct result of the bringing together of the short side edge portions 5*a*, 5*b*. During the final bringing together, the strip 6' snaps up when the locking element 8' enters the locking groove 14', so that the operative locking surfaces 10, 11 of the locking element 8' and of the locking groove 14' will engage each other.

By repeating the steps shown in FIGS. 1*a*-*c* and 2*a*-*c*, the whole floor can be laid without the use of glue and along all joint edges. Known floorboards of the above-mentioned type are thus mechanically joined usually by first angling them downwards on the long side, and when the long side has been secured, snapping the short sides together by means of horizontal displacement of the new board 1' along the long side of the previously installed board 1. The boards 1, 1' can be taken up in the reverse order of laying without causing any damage to the joint, and be laid again. These laying principles are also applicable to the present invention.

For optimal function, subsequent to being joined together, the boards should be capable of assuming a position along their long sides in which a small play can exist between the operative locking surface 10 of the locking element and the operative locking surface 11 of the locking groove 14. Reference is made to WO 9426999 for a more detailed description of this play. Such a play can be in the order of 0.01-0.05 mm between the operative locking surfaces 10, 11 when pressing the long sides of adjoining boards against each other. However, there need not be any play at the upper edge of the joint edges at the upper side of the floorboards.

In addition to what is known from the above-mentioned patent specifications, a licensee of Valinge Aluminium AB, Norske Skog Flooring AS, Norway (NSF), introduced a laminated floor with mechanical joining according to WO 9426999 in January 1996 in connection with the Domotex trade fair in Hannover, Germany. This laminated floor, which is shown in FIG. 4*a* and is marketed under the trademark Alloc®, is 7.2 mm thick and has a 0.6-mm aluminium strip 6 which is mechanically attached on the tongue side. The operative locking surface 10 of the locking element 8 has an inclination (hereinafter termed locking angle) of about 80° to the plane of the board. The locking element has an upper rounded guiding part and a lower operative locking surface. The rounded upper guiding part, which has a considerably lower angle than the locking surface, contributes significantly to positioning of the boards in connection with installation and facilitating the sliding-in of the locking element into the locking groove in connection with angling and snap action. The vertical connection is designed as a modified tongue-and-groove joint, the term "modified" referring to the possibility of bringing the tongue groove and tongue together by way of angling.

WO 9747834 (owner Unilin Beeher B. V., the Netherlands) describes a strip-lock system which has a fibreboard strip and is essentially based on the above known principles. In the corresponding product, "Uniclic®", which this owner began marketing in the latter part of 1997 and which is shown in FIG. 4*c*, one seeks to achieve biasing of the boards. This results in high friction and makes it difficult to angle the boards together and to displace them. The document shows several embodiments of the locking system. All locking surfaces have an angle that does not exceed 60° and the joint systems have no guiding surfaces.

Other known locking systems for mechanical joining of board materials are described in, for example, GB-A-2,256,023 showing unilateral mechanical joining for providing an expansion joint in a wood panel for outdoor use. The locking system does not allow joining of the joint edges and is not openable by upward angling round the joint edges. Moreover the locking element and the locking groove are designed in a way that does not provide sufficient tensile strength. U.S. Pat. No. 4,426,820 (shown in FIG. 4*e*) which concerns a mechanical locking system for a plastic sports floor, which floor is intentionally designed in such manner that neither displacement of the floorboards along each other nor locking of the short sides of the floorboards by snap action is allowed.

In the autumn of 1998, NSF introduced a 7.2-mm laminated floor with a strip-lock system which comprises a fibreboard strip and is manufactured according to WO 9426999 and WO 9966151. This laminated floor is marketed under the trademark "Fiboloc®" and has the cross-section illustrated in FIG. 4*b*.

In January 1999, Kronotex GmbH, Germany, introduced a 7.8 mm thick laminated floor with a strip lock under the trademark "Isilock®". A cross-section of the joint edge portion of this system is shown in FIG. 4*d*. Also in this floor, the strip is composed of fibreboard and a balancing layer.

During 1999, the mechanical joint system has obtained a strong position on the world market, and some twenty manufacturers have shown, in January 2000, different types of systems which essentially are variants of Fiboloc®, Uniclic® and Isilock®. All systems have locking surfaces with low locking angles and the guiding, in the cases where it occurs, is to be found in the upper part of the locking element.

SUMMARY OF THE INVENTION

Although the floors according to WO 9426999 and WO 99/66151 and the floor sold under the trademark Fiboloc® exhibit major advantages in comparison with traditional, glued floors, further improvements are desirable mainly in thin floor structures.

The vertical joint system, which comprises locking elements and locking grooves, has two coacting parts, viz. a locking part with operative locking surfaces which prevent the floorboards from sliding apart, and a guiding part, which positions the boards and contributes to the locking element being capable of being inserted into the locking groove. The greater the angular difference between the locking surface and the guiding part, the greater the guiding capacity.

The preferred embodiment of the locking element according to WO 9426999, having a rounded upper part and an essentially perpendicular lower locking surface, is ideal for providing a joint of high strength. The inward angling and snapping-in function is also very good and can be achieved with completely tight joint edges owing to the fact that the strip is bent downwards, whereby the locking element opens and snaps into the locking groove.

The drawback of this design of the locking element is the taking-up function, which is a vital part in most mechanical locking systems. The locking groove follows a circular arc with its centre in an upper joint edge (i.e. where the vertical joint plane intersects the upper side of the floorboard). If the locking groove has a locking angle corresponding to the tangent to the circular arc, below referred to as clearance angle, taking-up can be carried out without problems. If the locking angle is greater than the clearance angle, the parts of the locking system will overlap each other in upward angling, which makes the taking-up considerably more difficult.

Alloc® (see FIG. 4*a*) has an aluminium strip with a locking angle of about 80° and a clearance angle of about 65°. The other known systems with strips made integrally with the core of the floorboard have locking angles and clearance angles of 30-55° owing to the width of the strip being narrower and the radius of the circular arc being smaller. This results in low tensile strength in the horizontal direction D2 since the locking element easily slides out of the locking groove. Moreover, the horizontal tensile stress will be partly converted into an upwardly directed force which may cause the edges to rise. This basic problem will now be explained in more detail.

When the relative humidity, RH, changes from about 80% in summer to about 20% in winter, the floating floor shrinks by about 10 mm in a normal room. The motion takes place in a concealed manner under the skirting board at the surrounding walls. This shrinkage will move all furniture which exerts a load onto the floor. Tests have shown that if a room is fitted with heavy bookcases along the walls, the joint will be subjected to very high load or tensile stress in winter. At the long side this load may amount to about 300 kg/running metre of joint. At the short side where the load is distributed over a smaller joint width, the load may amount to 500 kg/running metre.

If the locking surfaces have a low locking angle, the strength of the joint will be reduced to a considerable extent. In winter the joint edges may slide apart so that undesirable visible joint gaps arise on the upper side of the floor. Besides, the angled locking surface of the locking element will press the upper locking surface of the locking groove upwards to the joint surface. The upper part of the tongue will press the upper part of the tongue groove upwards, which results in undesirable rising of the edges. The present invention is based on the understanding that these problems can be reduced to a considerable extent, for example, by making the locking surfaces with high locking angles exceeding 50° and, for instance, by the locking surfaces being moved upwards in the construction. The ideal design is perpendicular locking surfaces. Such locking surfaces, however, are difficult to open, especially if the strip is made of fibreboard and is not as flexible as strips of e.g. aluminium.

Perpendicular locking surfaces can be made openable if interaction between a number of factors is utilised. The strip should be wide in relation to the floor thickness and it should have good resilience. The friction between the locking surfaces should be minimised, the locking surface should be small and the fibre material in the locking groove, locking element and upper joint edges of the locking system should be compressible. Moreover, it is advantageous if the boards in the locked position can assume a small play of a few hundredths of a millimetre between the operative locking surfaces of the locking groove and the locking element if the long side edge portions of the boards are pressed together.

There are today no known products or methods which give sufficiently good solutions to problems which are related to essentially perpendicular locking surfaces which are at the same time easy to open.

It would be a great advantage if openable locking surfaces could be made with greater degrees of freedom and a high locking angle, preferably 90°, in combination with narrow strips which reduce waste in connection with working. The manufacture would be facilitated since working tools would only have to be guided accurately in the horizontal direction and the joint would obtain high strength.

To sum up, there is a great need for providing a locking system which takes the above-mentioned requirements, problems and desiderata into consideration to a greater extent than prior art. The invention aims at satisfying this need.

An object of the present invention therefore is to provide a locking system having (i) locking surfaces with a high locking angle and high strength, (ii) a horizontal joint system which has such locking surfaces and which at the same time is openable, and (iii) a horizontal joint system which has such locking surfaces and at the same time comprises guiding parts for positioning of the floorboards.

The invention is based on a first understanding that the identified problems must essentially be solved with a locking system where the locking element has an operative looking surface in its upper part instead of in its lower part as in prior-art technique. When taking up an installed floor by upward angling, the locking surface of the locking groove will therefore exert a pressure on the upper part of the locking element. This results in the strip being bent backwards and downwards and the locking element being opened in the same way as in inward angling. In a suitable design of locking element and locking groove, this pressure can be achieved in a part of the locking element which is closer to the top of the locking element than that part of the locking element which is operative in the locked position. In this way, the opening force will be lower than the locking force.

The invention is also based on a second understanding which is related to the motions during upward angling and taking-up of an installed floor. The clearance angling, i.e. the tangent to a circular arc with its centre where the vertical joint plane intersects the upper side of the floorboard, is higher in the upper part of the locking element than in its lower part. If a part of the locking surface, which in prior-art technique is placed in the lower part of the locking element and the locking groove respectively, is placed in the upper part instead according to the invention, the difference in degree between the locking angle and the clearance angle will be smaller, and the opening of the locking when taking up an installed floor will be facilitated.

The invention is also based on a third understanding which is related to the guiding of the floorboards during inward angling when the floor is to be laid. Guiding is of great importance in inward angling of the long sides of the floorboards since the floorboards have often warped and curved and therefore are somewhat arcuate or in the shape of a "banana". This shape of a banana can amount to some tenths of a millimetre and is therefore not easily visible to the naked eye in a free board. If the guiding capacity of the locking system exceeds the maximum banana shape, the boards can easily be angled downwards, and they need not be pressed firmly against the joint edge in order to straighten the banana shape and allow the locking element to be inserted into the locking groove. In prior-art locking systems, the guiding part is formed essentially in the upper part of the locking element, and if the locking surface is moved up to the upper part, it is not possible to form a sufficiently large guiding part. A sufficiently great and above all more efficient and reliable guiding is achieved according to the invention by the guiding part being moved to the locking groove and its lower part. According to the invention it is even possible to form the entire necessary guiding in the lower part of the locking groove. In preferred embodiments, coacting guiding parts can also be formed both in the upper part of the locking element and the lower part of the locking groove.

According to a first aspect of the invention, a locking system is provided of the type which is stated by way of introduction and which according to the invention is characterised by the combination that the locking element has at least one operative locking surface which is positioned in the upper part of the locking element, that this operative locking surface is essentially plane and in relation to the plane of the boards has an angle (A) which exceeds 50°, that the locking groove has at least one locking surface which is essentially plane and which cooperates with said locking surface of the locking element, that the locking groove has a lower inclined or rounded guiding part which guides the locking element into the locking groove by engagement with a portion of the locking element which is positioned above the locking surface of the locking element or adjacent to its upper edge.

The invention concerns a locking system for mechanical joining of floorboards and a floorboard having such a locking system. The locking system has mechanical cooperating means for vertical and horizontal joining of adjoining floorboards. The means for horizontal joining about a vertical joint plane comprise a locking groove and a locking strip which are positioned at the opposite joint edge portions of the floorboard. The locking strip extends from the joint plane and has an upwardly projecting locking element at it free end. The locking groove is formed in the opposite joint edge portion of the floor-board at a distance from the joint plane. The locking groove and the locking element have operative locking surfaces. These locking surfaces are essentially plane and positioned at a distance from the upper side of the projecting strip and in the locking groove and form an angle of at least 50° to the upper side of the board. Moreover, the locking groove has a guiding part for cooperation with a corresponding guiding part of the locking element.

DESCRIPTION OF PREFERRED EMBODIMENTS

Prior to the description of preferred embodiments, with reference to FIG. 5, a detailed explanation will first be given of the most important parts in a strip lock system.

The invention can be applied in joint systems with a worked strip which is made in one piece with the core of the board, or with a strip which is integrated with the core of the board but which has been made of a separate material, for instance aluminium. Since the worked embodiment, where strip and core are made of the same material, constitutes the greatest problem owing to higher friction and poorer flexibility, the following description will focus on this field of application.

Figure 1A:
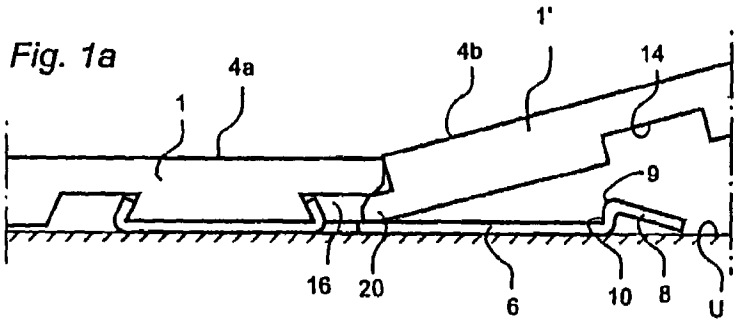
FIGS. 1*a-c* show in three stages a downward angling method for mechanical joining of long sides of floorboards according to WO 9426999.
Figure 1B:
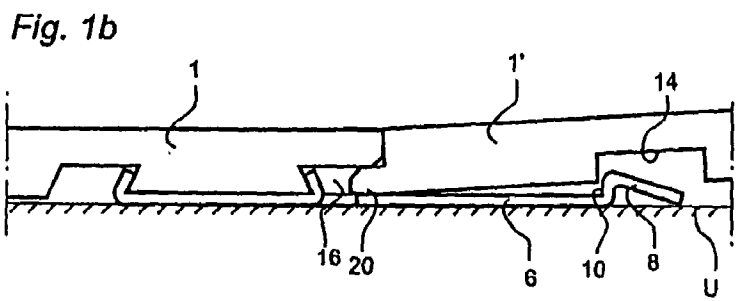
Figure 1C:
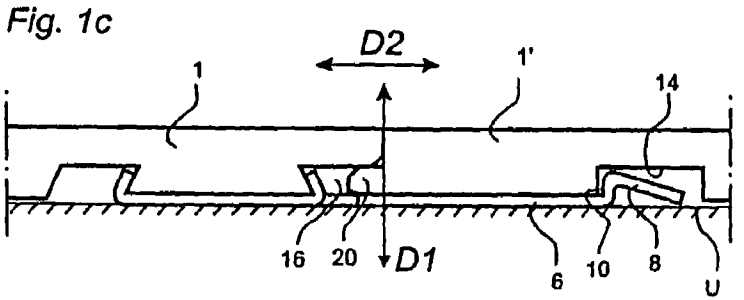
Fig. 1c PRIOR ART
Figure 2A:
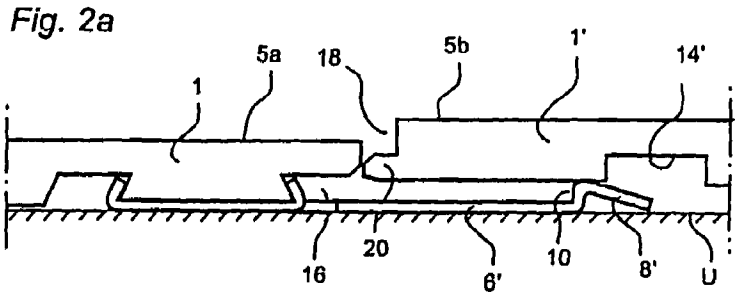
FIGS. 2*a-c* show in three stages a snap-action method for mechanical joining of short sides of floorboards according to WO 9426999.
Figure 2B:
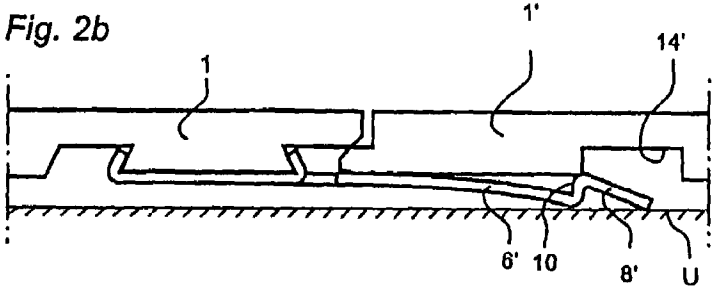
Figure 2C:
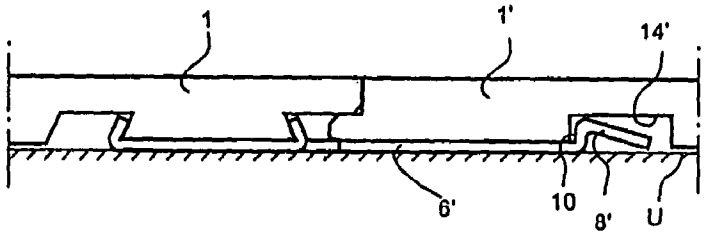
Fig. 2c PRIOR ART
Figure 3A:
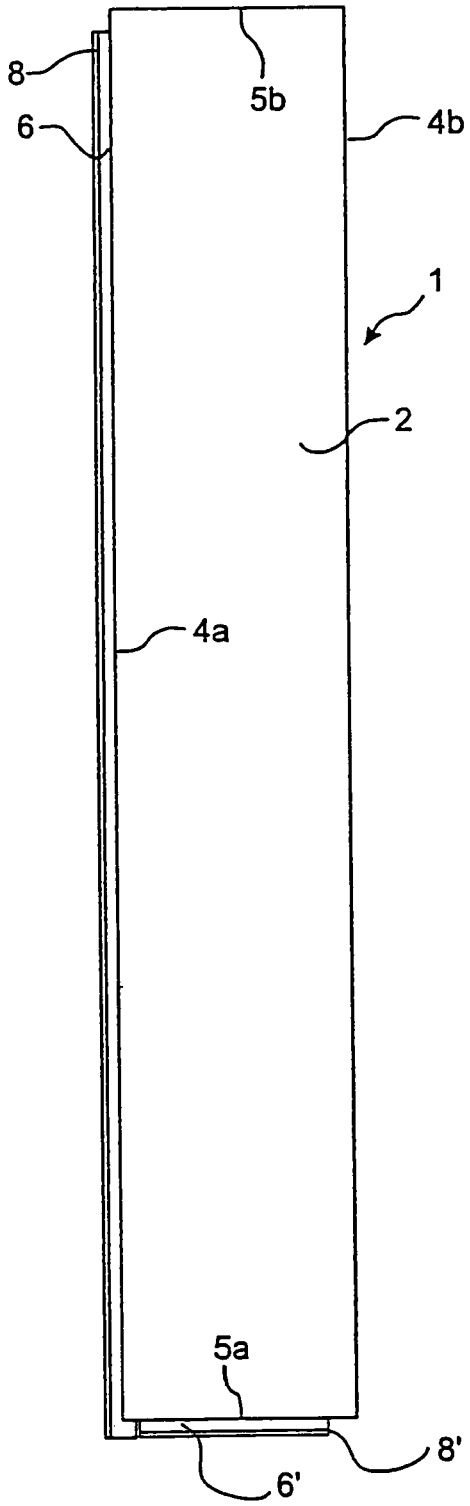
FIGS. 3*a-b* are a top plan view and a bottom view respectively of a floorboard according to WO 9426999.
Figure 3B:
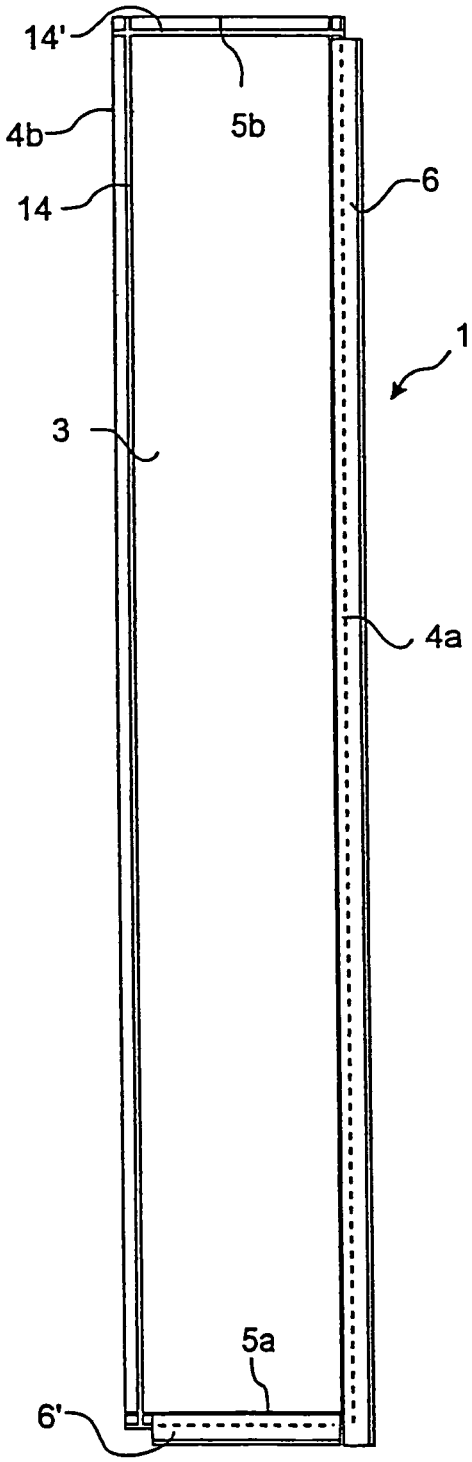
Figure 4A:
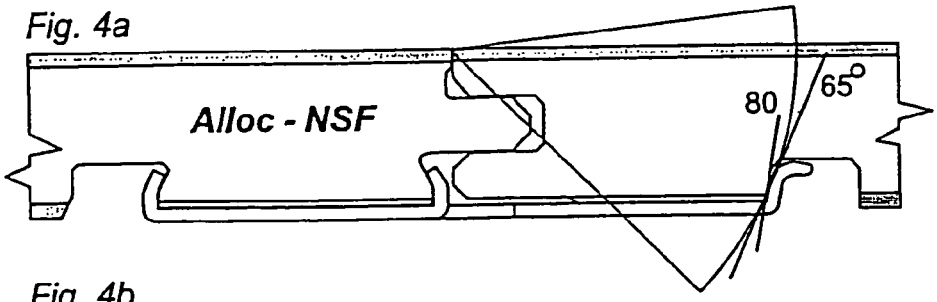
FIGS. 4*a-e* show four strip-lock systems available on the market and a strip-lock system according to U.S. Pat. No. 4,426,820.
Figure 4B:
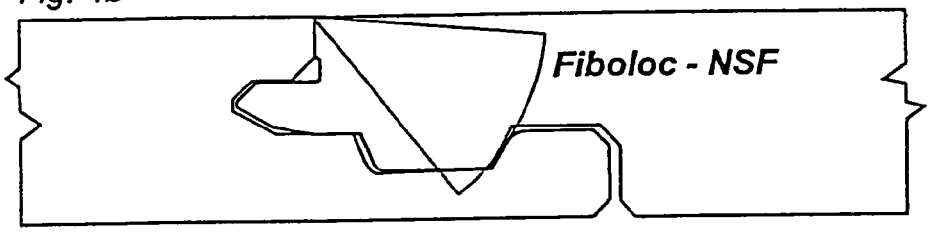
Figure 4C:
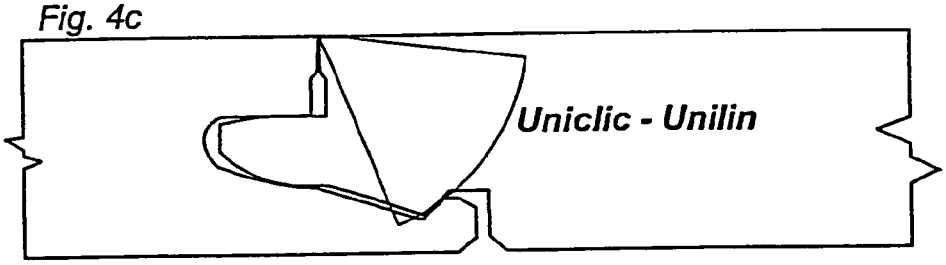
Figure 4D:
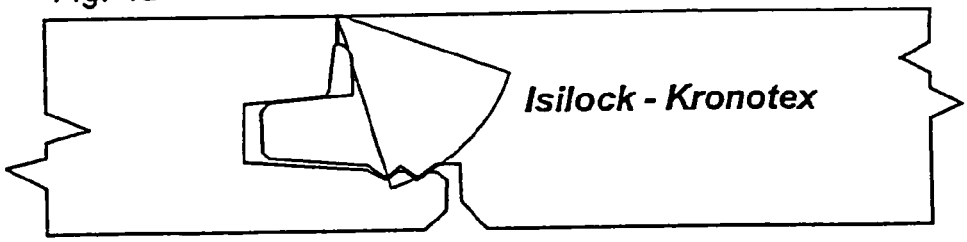
Figure 4E:
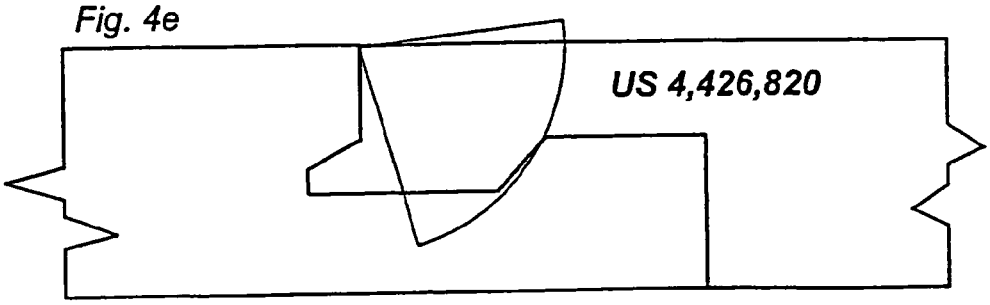
Figure 5:
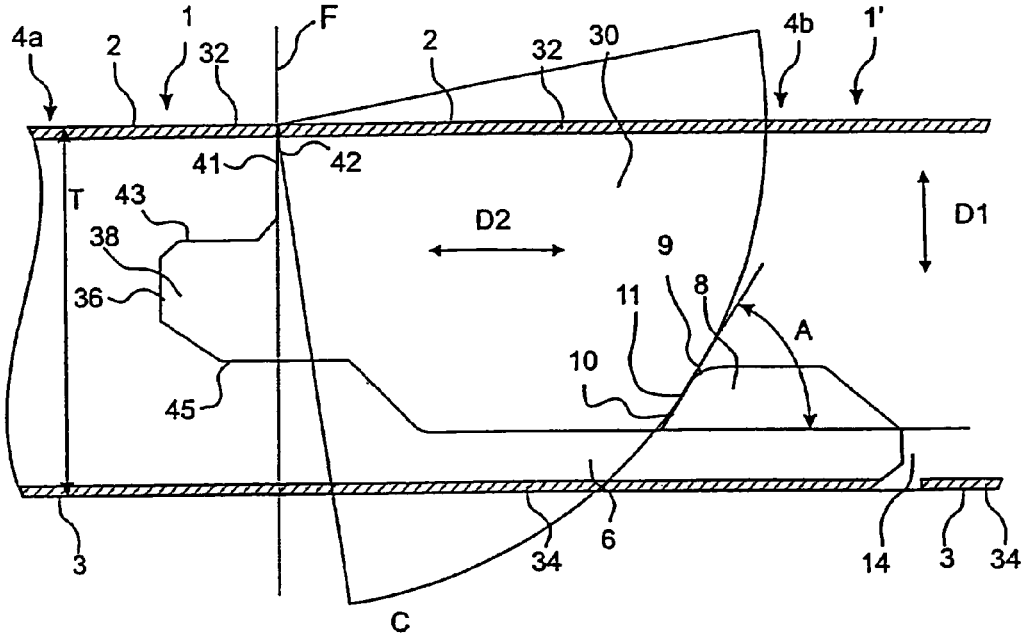
FIG. 5 shows in detail the basic principles of a known strip-lock system for joining of the long sides of floorboards according to WO 9966151.

The cross-sections shown in FIG. 5 are hypothetical, not published cross-sections, but they are fairly similar to the locking system of the known floorboard "Fiboloc" and to the locking system according to WO 9966151. Accordingly, FIG. 5 does not represent the invention but is only used a starting point of a description of the technique for a strip lock system for mechanical joining of adjoining floorboards. Parts corresponding to those in the previous Figures are in most cases provided with the same reference numerals. The construction, function and material composition of the basic components of the boards in FIG. 5 are essentially the same as in embodiments of the present invention, and consequently, where applicable, the following description of FIG. 5 also applies to the subsequently described embodiments of the invention.

In the embodiment shown, the boards 1, 1' in FIG. 5 are rectangular with opposite long side edge portions 4*a*, 4*b* and opposite short side edge portions 5*a*, 5*b*. FIG. 5 shows a vertical cross-section of a part of a long side edge portion 4*a* of the board 1, as well as a part of a long side edge portion 4*b* of an adjoining board 1'. The boards 1 have a core 30 which is composed of fibreboard and which supports a surface layer 32 on its front side (upper side) and a balancing layer 34 on its rear side (underside). A strip 6 is formed from the core and balancing layer of the floorboard by cutting and supports a locking element 8. Therefore the strip 6 and the locking element 8 in a way constitute an extension of the lower part of the tongue groove 36 of the floorboard 1. The locking element 8 formed on the strip 6 has an operative locking surface 10 which cooperates with an operative locking surface 11 in a locking groove 14 in the opposite long side edge portion 4*b* of the adjoining board 1'. By the engagement between the operative locking surfaces 10, 11 a horizontal locking of the boards 1, 1' transversely of the joint edge (direction D2) is obtained. The operative locking surface 10 of the locking element 8 and the operative locking surface 11 of the locking groove 14 form a locking angle A with a plane parallel with the upper side of the floorboards. This locking angle A of 60° corresponds to the tangent to a circular arc C which has its centre in the upper joint edge, i.e. the intersection between the joint plane F and the upper side of the boards, and which passes the operative locking surfaces 10, 11. In upward angling of the floorboard 1' relative to the floorboard 1, the locking groove will follow the circular arc C, and taking-up can therefore be made without resistance. The upper part of the locking element has a guiding part 9, which in installation and inward angling guides the floorboard to the correct position.

To form a vertical lock in the D1 direction, the joint edge portion 4*a* has a laterally open tongue groove 36 and the opposite joint edge portion 4*b* has a laterally projecting tongue 38 which in the joined position is received in the tongue groove 36. The upper contact surfaces 43 and the lower contact surfaces 45 of the locking system are also plane and parallel with the plane of the floorboard.

In the joined position according to FIG. 5, the two juxtaposed upper portions 41 and 42 of the surfaces, facing each other, of the boards 1, 1' define a vertical joint plane F.

Figure 6:
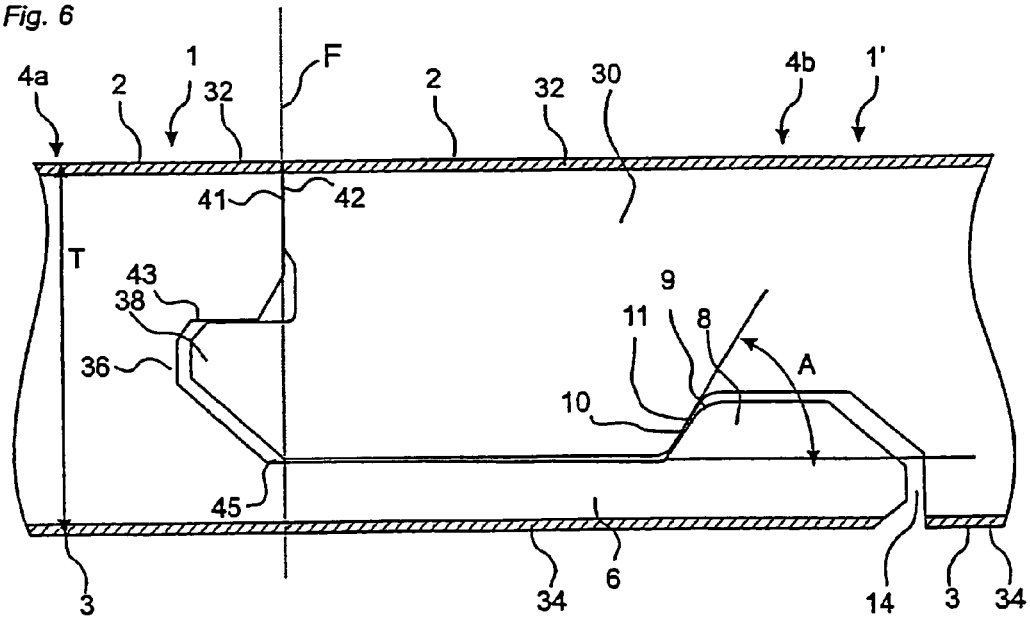
PRIOR ART Fig. 6
FIG. 6 shows a variant of a locking system (applicant Valinge Aluminium AB) for which protection is sought and which has not yet been published.

FIG. 6 shows an example of an embodiment according to the invention, which has not yet been published and which differs from the embodiment in FIG. 5 by the tongue 38 and the tongue groove 36 being displaced downwards in the floorboard so that they are eccentrically positioned. Moreover, the thickness of the tongue 38 (and, thus, the tongue groove 36) has been increased while at the same time the relative height of the locking element 8 has been retained. Both the tongue 38 and the material portion above the tongue groove 36 are therefore significantly more rigid and stronger while at the same time the floor thickness T, the outer part of the strip 6 and the locking element 8 are unchanged.

Figure 7:
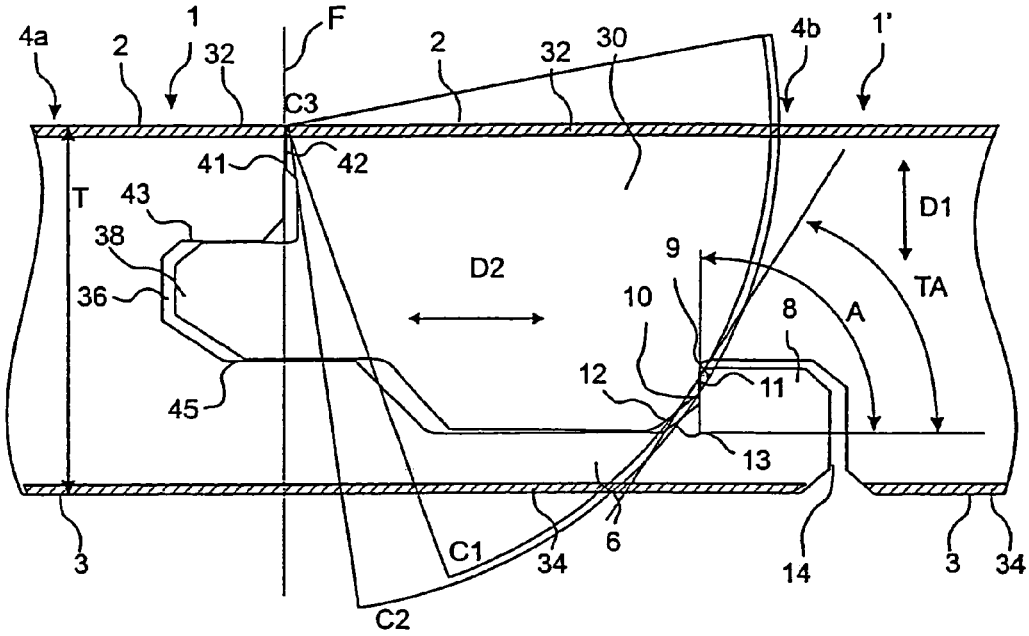
FIGS. 7+8 illustrate a locking system according the invention.

FIG. 7 shows a first embodiment of the present invention. The locking element 8 has a locking surface 10 with a locking angle A which is essentially perpendicular to the plane of the floorboards. The locking surface 10 has been moved upwards relative to the upper side of the strip 6, compared with prior-art technique.

The locking angle A in this embodiment of the invention is essentially greater than a clearance angle TA, which corresponds to the tangent to a circular-arc C1 which is tangent to the upper part of the locking element 8 and which has it centre C3 where the joint plane F intersects the upper side of the boards.

Since the edge of the locking groove 14 closest to the joint plane F has portions which are positioned outside the circular arc C1 to be able to retain the locking element 8 in the locking groove, these portions will, in taking-up of the floorboard 1', follow a circular arc C2 which is concentric with and has a greater diameter than the circular arc C1 and which intersects the lower edge of the operative locking surface 11 of the locking groove. Taking-up of the floorboard 1' by upward angling requires that the strip 6 can be bent or that the material of the floorboards 1, 1' can be compressed.

In a preferred embodiment of the invention, the boundary surface of the locking groove 14 closest to the joint plane F has a lower guiding part 12 which is positioned inside the circular arc C1 and which will therefore efficiently guide the locking element 8 in connection with the laying of the floor and the downward angling of the floorboard 1' relative to the floorboard 1.

FIG. 7 also shows that the operative locking surface 11 of the locking groove 14 and the operative locking surface 10 of the locking element 8 have been moved upwards in the construction and are located at a distance from the upper side of the locking strip 6. This positioning brings several advantages which will be discussed in the following.

As is also evident from FIG. 7, there is an inclined surface 13 between the upper side of the locking strip 6 and the lower edge of the operative locking surface 10 of the locking element 8. In this shown embodiment, there is a gap between this inclined surface 13 and the guiding part 12 of the locking groove 14, so that the transition of the guiding part to the under side of the edge portion 4*b* is located inside the circular arc C1. Owing to such a gap, the friction is reduced in mutual displacement of the floorboards along the joint plane F in connection with the laying of the floor.

Figure 8:
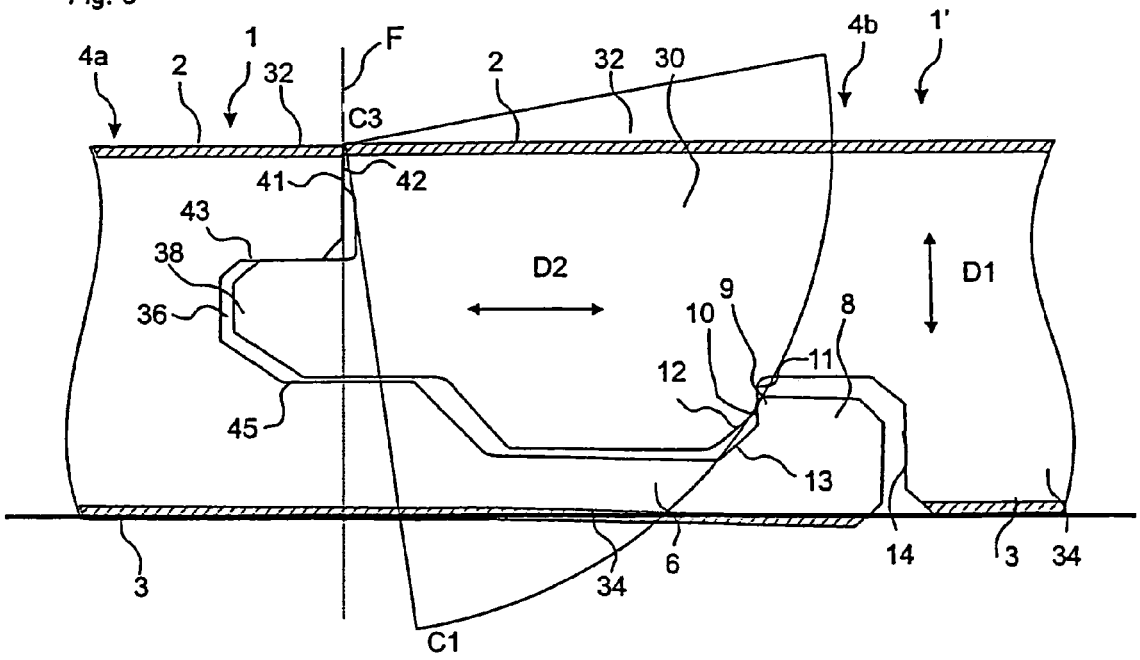

FIG. 8 shows how upward angling can take place when taking up an installed floor. The locking surface 11 of the locking groove exerts a pressure on the upper part of the operative locking surface 10 of the locking element 8. This pressure bends the strip 6 downwards and the locking element 8 backwards and away from the joint plane F. In practice, a marginal compression of the wood fibres in the upper joint edge surfaces 41, 42 of the two floorboards and of the wood fibres in the locking surface 10 of the locking element and the locking surface 11 of the locking groove takes place. If the joint systems are besides designed in such manner that the boards in their locked position can assume a small play of some hundredths of a millimetre between the locking surfaces 10, 11, opening by upward angling can take place as reliably and with the same good function as if the locking surfaces were inclined.

Figure 9:
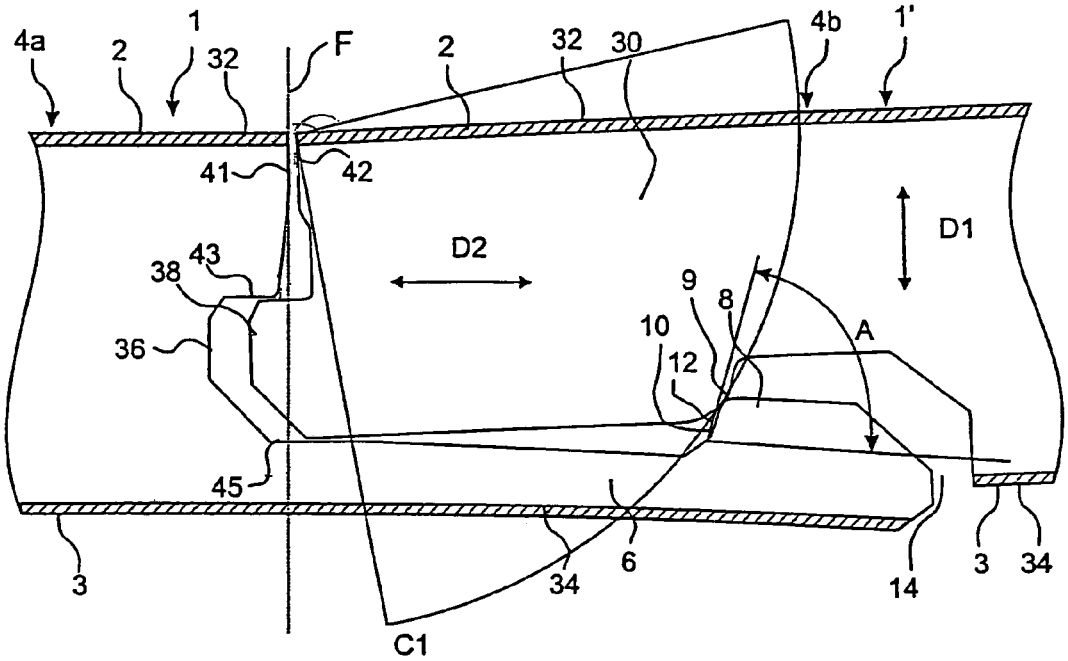
FIG. 9 shows another example of a floorboard and a locking system according to the present invention.

FIG. 9 shows another embodiment of the invention. In this embodiment, the groove 36 and the tongue 38 have been made shorter than in the embodiment according to FIGS. 7 and 8. As a result, the mechanical locking of two adjoining floorboards 1, 1' can be carried out both by vertical snap action and by inward angling during the bending of the strip. The vertical snap action can also be combined with known shapes of locking surfaces and with a possibility of displacement along the joint direction in the locked position and also taking-up by pulling out along the joint edge or upward angling. However, the Figure shows the floorboards during inward angling of the floorboard 1'. The lower part or guiding part 12 of the locking groove guides the floorboards and enables the introduction of the locking element 8 into the locking groove 14 so that the locking surfaces 10, 11 will engage each other. The strip 6 is bent downwards and the locking element 8 is guided into the locking groove although the edge surface portions 41, 42, facing each other, of the floorboards are spaced apart. The locking angle A is in this embodiment about 80°. The bending of the strip can be facilitated by working the rear side of the strip, so that a part of the balancing layer 34 between the joint plane F and the locking element 8 is wholly or partly removed.

Figure 10:
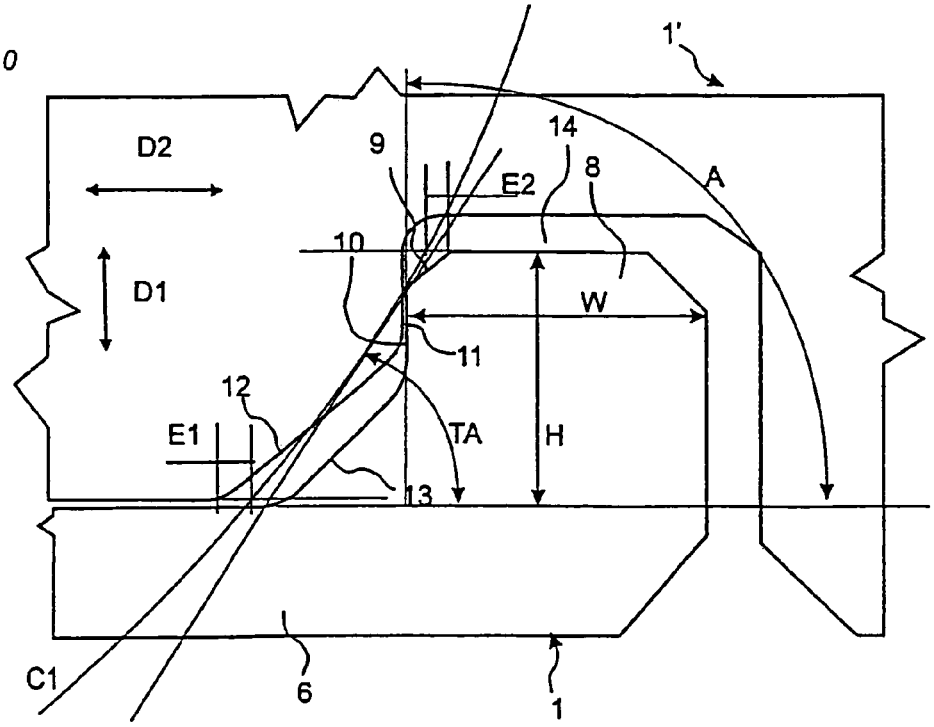
FIGS. 10-12 show variants of a locking groove and a locking component of three further examples of a floorboard and a locking system according to the present invention.

FIG. 10 shows an enlargement of the locking element 8 and the locking groove 14. The locking element 8 has an operative upper locking surface 10 which is formed in the upper part of the locking element at a distance from the upper side of the locking strip 6. The locking groove 14 has a cooperating operative locking surface 11 which has also been moved upwards and which is at a distance from the opening of the locking groove 14.

Operative locking surfaces relate to the surfaces 10, 11 which, when locked and subjected to tension load, cooperate with each other. Both surfaces are in this embodiment plane and essentially at right angles to the principal plane of the floorboards. The locking groove has a guiding part 12 which is located inside the previously mentioned circular arc C1 and which in this embodiment is tangent to the upper part of the operative locking surface 10 of the locking element 8.

In this embodiment, the locking element has in its upper part a guiding part 9 which is located outside the circular arc C1. The guiding parts 9, 12 of the locking element and the locking groove respectively contribute to giving the joint system a good guiding capacity. The total lateral displacement of the floorboards 1, 1' in the final phase of the laying procedure is therefore the sum of E1 and E2 (see FIG. 10), i.e. the horizontal distance between the lower edge of the guiding part 12 and the circular arc C1 and between the upper edge of the guiding part 9 and the circular arc C1. This sum of E1 and E2 should be greater than the above-mentioned maximum banana shape of the floorboards. For the joint system to have a guiding capacity, E1 and E2 must be greater than zero, and both E1 and E2 can have negative values, i.e. be positioned on the opposite side of the circular arc C1 relative to that shown in the Figure.

The guiding capacity is further improved if the strip 6 is bendable downwards and if the locking element 8 is bendable away from the joint plane so that the locking surface 10 of the locking element can open when the locking element comes into contact with a part of the other board. A free play between surfaces which are not operative in the locking system facilitates manufacture since such surfaces need not be formed with narrow tolerances. The surfaces which are operative in the locking system and which are intended to engage each other in the laid floor, i.e. the operative locking surfaces 10, 11, the edge surface portions 41, 42 and the upper contact surfaces 43 between the groove 36 and the tongue 38 must, however, be manufactured with narrow tolerances both as regards configuration and as regards their relative positions.

If the inoperative surfaces in the locking system are spaced from each other, the friction in connection with lateral displacement of joined floorboards along the joint edge will decrease.

According to the invention, the operative locking surfaces 10, 11 of the locking element and in the locking groove have been formed with a small height, seen perpendicular to the principal plane of the floorboards. This also reduces the friction in lateral displacement of joined floorboards along the joint edge.

By the operative locking surfaces according to the invention being made essentially plane and parallel with the joint plane F, the critical distance between the joint plane F and the locking surface 10 and 11, respectively, can easily be made with very high precision, since the working tools used in manufacture need only be controlled with high precision essentially horizontally. The tolerance in the vertical direction only affects the height of the operative locking surfaces but the height of the locking surfaces is not as critical as their position in the horizontal direction Using modern manufacturing technique, the locking surface can be positioned in relation to the joint plane with a tolerance of ±0.01 mm. At the same time the tolerance in the vertical direction can be ±0.1 mm, which results in, for instance, the height of the operative locking surfaces varying between 0.5 mm and 0.3 mm. Tensile tests have demonstrated that operative locking surfaces with a height of 0.3 mm can give a strength corresponding to 1000 kg/running metre of joint. This strength is considerably higher than required in a normal floor joint. The height H of the locking element 8 above the upper side of the strip 6 and the width W of the locking element 8 on a level with the operative locking surface are important to the strength and the taking-up of the floorboards.

At the long side where the strength requirements are lower, the locking element can be made narrower and higher. A narrow locking element bends more easily and facilitates removal of installed floorboards.

At the short side where the strength requirements are considerably higher, the locking element should be low and wide. The lower front part 13 of the locking element, i.e. the locking element portion between the lower edge of the locking surface 10 and the upper side of the strip 6, has in this embodiment an angle of about 45°. Such a design reduces the risk of cracking at the border between the upper side of the strip 6 and the locking element 8 when subjecting the installed floor to tensile load.

Figure 11:
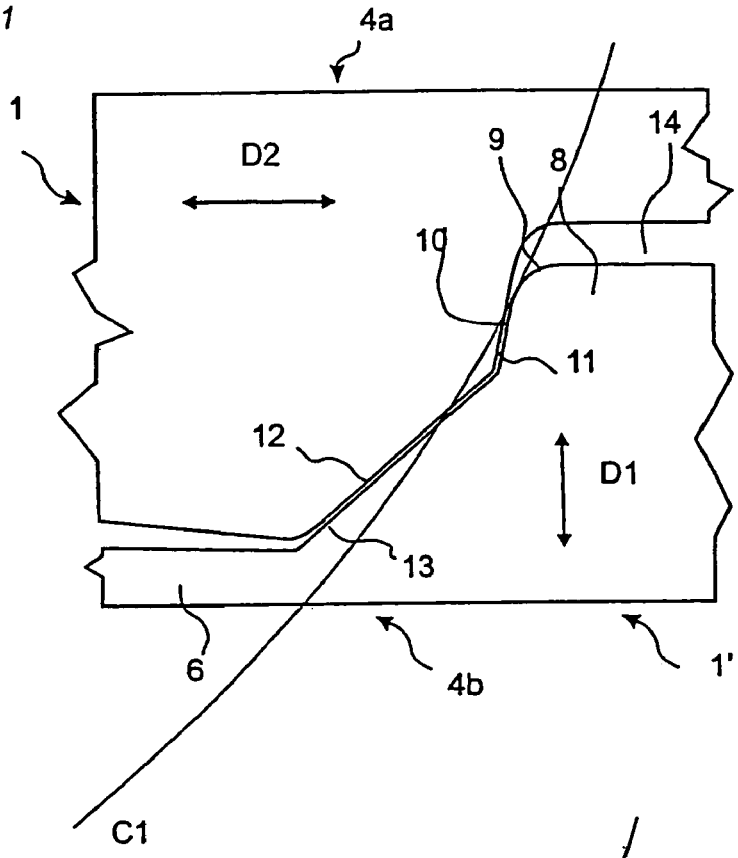

FIG. 11 shows another embodiment of the invention. In this case, use is made of a locking element 8 which has an upper operative locking surface 10 with an angle of about 85° which is greater than the clearance angle, which is about 75°. In this embodiment, the guiding part 12 of the locking groove 14 is also used as a secondary locking surface which supplements the operative locking surfaces 10, 11. This embodiment result-s in very high locking forces. The drawback of this embodiment, however, is that the friction in connection with relative displacement of the floorboards 1, 1' in the lateral direction along the joint plane F will be considerably greater.

Figure 12:
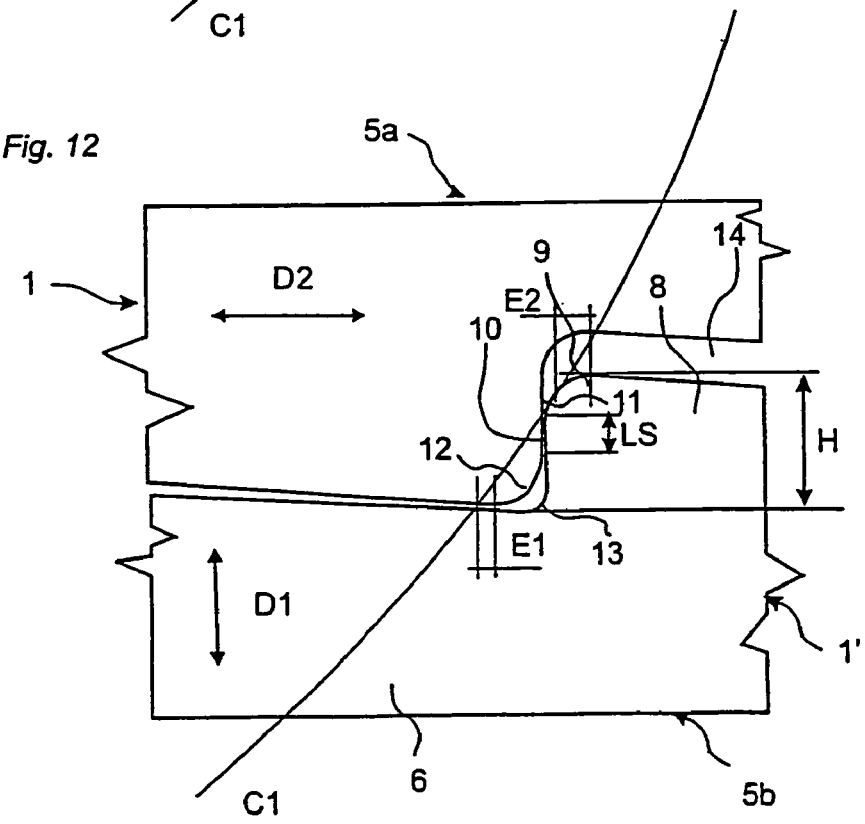

FIG. 12 shows one more embodiment with essentially perpendicular locking surfaces 10, 11 and small guiding parts 9, 12, which makes it necessary to bend the strip 6 in connection with laying of the floorboards. The joint system is very convenient for use at the short sides of the floorboards where the need for guiding is smaller since in practice there is no "banana shape". Opening of the short side can be effected by the long sides first being angled upwards, after which the short sides are displaced in parallel along the joint edge. Opening can also be effected by upward angling if the locking groove and the locking element have suitably designed guiding parts 12, 9 which are rounded or which have an angle less than 90°, and if the operative locking surfaces 10, 11 have a small height LS (FIG. 12), so that their height is less than half the height of the locking element. In this embodiment, E2 is greater than E1, which makes the sum of E2 and E1 greater than zero (E1 represents in this case a negative value). If in this case E1 and E2 should be of almost the same size, the guiding may be effected by downward bending of the strip 6, which automatically causes displacement of the guiding part 9 of the locking element 8 away from the intended joint plane F and also causes a change in angle of the locking element 8 so that guiding takes place.

Several variants of the invention are feasible. The joint system can be manufactured with a large number of different joint geometries, some or all of the above parameters being made different, especially when it is desirable to give priority to a certain property over the other properties.

The owner has taken into consideration and tested a number of variants based on that stated above.

The height of the locking element and the angle of the locking surfaces can be varied. Nor is it necessary for the locking surface of the locking groove and the locking surface of the locking element to have the same inclination or configuration. Guiding parts can be made with different angles and radii. The height of the locking element can vary over its width in the principal plane of the floorboard, and the locking element can have different widths at different levels. The same applies to the locking groove. The locking surface of the locking groove can be made with a locking angle exceeding 90° or be made slightly rounded. If the locking surfaces of the locking element is made with an angle exceeding 90°, taking-up of the floorboards by upward angling can be prevented and permanent locking can be achieved. This can also be achieved with a joint system having 90° locking surfaces which are sufficiently large or in combination with specially designed guiding parts which counteract upward angling. Such locking systems are particularly suited for short sides which require a high locking force.

The invention claimed is:

1. A locking system for mechanical joining of floorboards, said locking system comprising:

for horizontal joining of a first and a second joint edge portion of a first and a second floorboard respectively at a vertical joint plane:

a locking groove which is formed in the underside of said second board and extends parallel with and at a distance from said vertical joint plane at said second joint edge, a strip integrally formed with a core of said first board, which strip at said first joint edge projects from said vertical joint plane and supports an upwardly directed locking element with a locking surface for coaction with a locking surface in said locking groove, and first contact surfaces at the vertical joint plane; and for vertical joining of the first and second joint edge portions:

a tongue which extends from the joint plane and having an upper tongue surface and a lower tongue surface, a tongue groove adapted to coact with said tongue, the tongue groove having an upper tongue groove surface and a lower tongue groove surface, and coacting second contact surfaces positioned in said tongue groove and on said tongue, wherein the locking surfaces, the coacting second contact surfaces, and the first contact surfaces at the vertical joint plane are configured to be operative surfaces in a laid floor; and further comprising:

a first inoperative space in the locking system between the first coacting contact surfaces and the second coacting contact surfaces when the first and the second floorboards are joined horizontally and vertically, a second inoperative space in the locking system between the second coacting contact surfaces and the locking surfaces when the first and the second floorboards are joined horizontally and vertically, and the lower tongue groove surface and the lower tongue surface are not in direct contact with each other when the first and the second floorboards are joined horizontally and vertically, wherein said inoperative spaces are configured to be spaced from each other when the first and the second floorboards are joined horizontally and vertically.

2. The locking system as claimed in claim 1, wherein the floorboards comprise a core, a surface layer on the upper side of the core and a balancing layer on the rear side of the core.

3. The locking system as claimed in claim 2, wherein said operative locking surface of the locking element is essentially planar.

4. The locking system as claimed in claim 3, wherein the operative locking surface of the locking element is located at an upper part of the locking element at a distance from an upper side of the projecting strip and faces the joint plane.

5. The locking system as claimed in claim 4, wherein the locking groove has at least one essentially planar operative locking surface which is located in the locking groove at a distance from an opening of the locking groove and which is designed to cooperate with said locking surface of the locking element in the joined position, the locking groove at a lower edge closest to the joint plane has an inclined or rounded guiding part which extends from the locking surface of the locking groove and to the opening of the locking groove and which is adapted to guide the locking element into the locking groove by engaging a portion of the locking element which is positioned above the locking surface of the locking element or adjacent to its upper edge.

6. The locking system as claimed in claim 5, wherein said operative locking surfaces of the locking element and the locking groove make a locking angle of at least 50 degree to the upper side of the boards.

7. The locking system as claimed in claim 3, wherein said operative locking surfaces of the locking element and the locking groove make a locking angle of at least 50 degree to the upper side of the boards.

8. The locking system as claimed in claim 3, wherein elements of the locking system which cooperate for vertical locking and elements of the locking system which cooperate for horizontal locking have a configuration that allows insertion of the locking element into the locking groove by inward angling of one floorboard towards the other floorboard while maintaining contact between the joint edge surface portions of the two floorboards close to the border between the joint plane and the upper side of the floorboards.

9. The locking system as claimed in claim 8, wherein elements of the locking system which cooperate for vertical locking and elements of the locking system which cooperate for horizontal locking have a configuration which allows insertion of the locking element into the locking groove by a substantially horizontal motion of one floorboard towards the other floorboard during bending of the integrated strip for snapping in the locking element into the locking groove.

10. The locking system as claimed in claim 3, wherein elements of the locking system which cooperate for vertical locking and elements of the locking system which cooperate for horizontal locking have a configuration which allows insertion of the locking element into the locking groove by a substantially horizontal motion of one floorboard towards the other floorboard during bending of the integrated strip for snapping in the locking element into the locking groove.

11. A locking system for mechanical joining of floorboards, said locking system comprising:

for horizontal joining of a first and a second joint edge portion of a first and a second floorboard respectively at a vertical joint plane:

a locking groove which is formed in the underside of said second board and extends parallel with and at a distance from said vertical joint plane at said second joint edge, a strip integrally formed with the core of said first board, which strip at said first joint edge projects from said vertical joint plane and supports an upwardly directed locking element with a locking surface for coaction with a locking surface in said locking groove, and first coacting contact surfaces at the vertical joint plane, and for vertical joining of the first and second joint edge portions:

a tongue which extends from the joint plane and having an upper tongue surface, a tongue groove adapted to coact with said tongue and having an upper tongue groove surface, wherein the upper tongue surface and the upper tongue groove surface comprise second coacting contact surfaces in said tongue groove and on said tongue, and wherein the locking surfaces, the first coacting contact surfaces at the vertical joint plane and the second coacting contact surfaces are configured to be operative surfaces in a laid floor; and wherein all other adjacent surfaces in the locking system are inoperative surfaces in the locking system and said inoperative surfaces are configured to be spaced from each other when the first and the second floorboards are joined horizontally and vertically.

12. The locking system as claimed in claim 11, wherein the floorboards comprise a core, a surface layer on the upper side of the core and a balancing layer on the rear side of the core.

* * * * *